US005313906A

United States Patent [19]

Zapka

[11] Patent Number: 5,313,906

[45] Date of Patent: May 24, 1994

[54] SMALL WATERPLANE TWIN HULL VESSEL

[75] Inventor: Manfred J. Zapka, Honolulu, Hi.

[73] Assignee: Pacific Marine Supply Co., Ltd., Honolulu, Hi.

[21] Appl. No.: 903,014

[22] Filed: Jun. 22, 1992

[51] Int. Cl.[5] ..... B63B 1/12

[52] U.S. Cl. ..... 114/274; 114/283; 114/61

[58] Field of Search ..... 114/56, 57, 61, 123, 114/274, 283

[56] References Cited

U.S. PATENT DOCUMENTS

| | | | |
|---|---|---|---|
| 1,587,209 | 6/1926 | Bauer | 114/61 |
| 4,002,132 | 1/1977 | Nitzki | 114/61 |
| 4,557,211 | 12/1985 | Schmidt | 114/61 |
| 4,944,238 | 7/1990 | Lang | 114/61 |

FOREIGN PATENT DOCUMENTS

| | | | |
|---|---|---|---|
| 1254986 | 11/1967 | Fed. Rep. of Germany | 114/61 |
| 60788 | 5/1981 | Japan | 114/61 |
| 82687 | 7/1981 | Japan | 114/61 |

*Primary Examiner*—Andres Kashnikow
*Assistant Examiner*—Stephen P. Avila
*Attorney, Agent, or Firm*—Fitzpatrick, Cella, Harper & Scinto

[57] ABSTRACT

A small waterplane area twin hull (SWATH) vessel is disclosed which includes a pair of normally submerged hulls that provide buoyancy support for the vessel. An upper hull platform located above the design water line of the vessel is connected to the submerged hulls by at least two pairs of struts respectively associated with each of the submerged hulls. The submerged hulls are arranged to define an acute angle between them. In one embodiment the vertex of the angle is rearward of the submerged hull and in another embodiment it is forward of the submerged hull. In other embodiments of the invention the struts are arranged to define dihedral angles between the struts and the upper hull platform. In addition, the struts may be angled with respect to the center line of the vessel.

42 Claims, 5 Drawing Sheets

FIG. 4
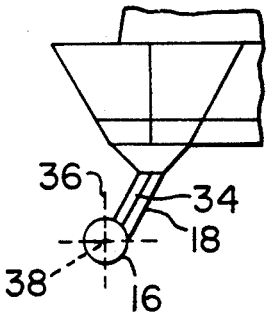
FIG. 5
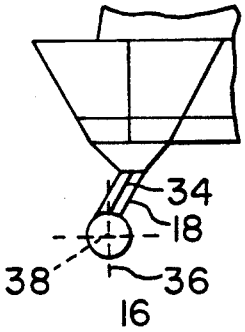
FIG. 5A
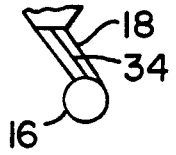
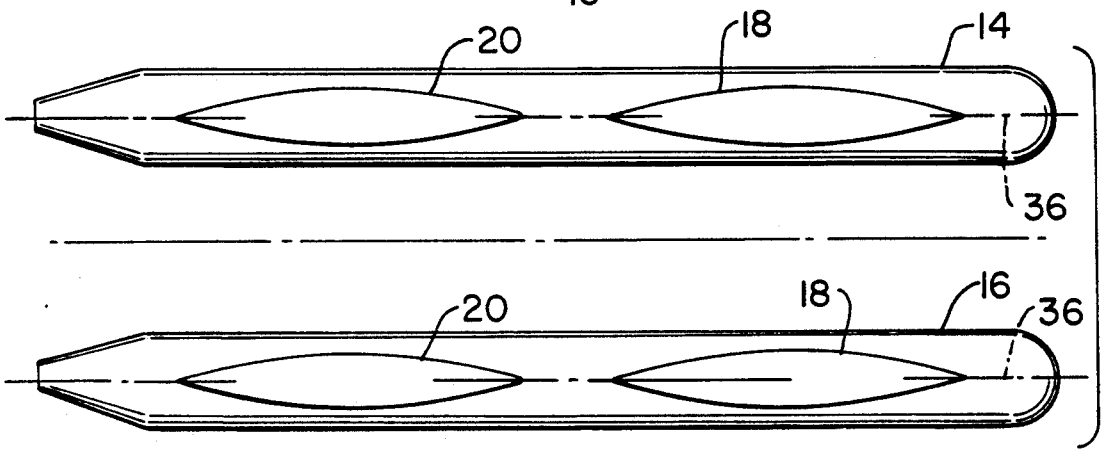
FIG. 6
(PRIOR ART)
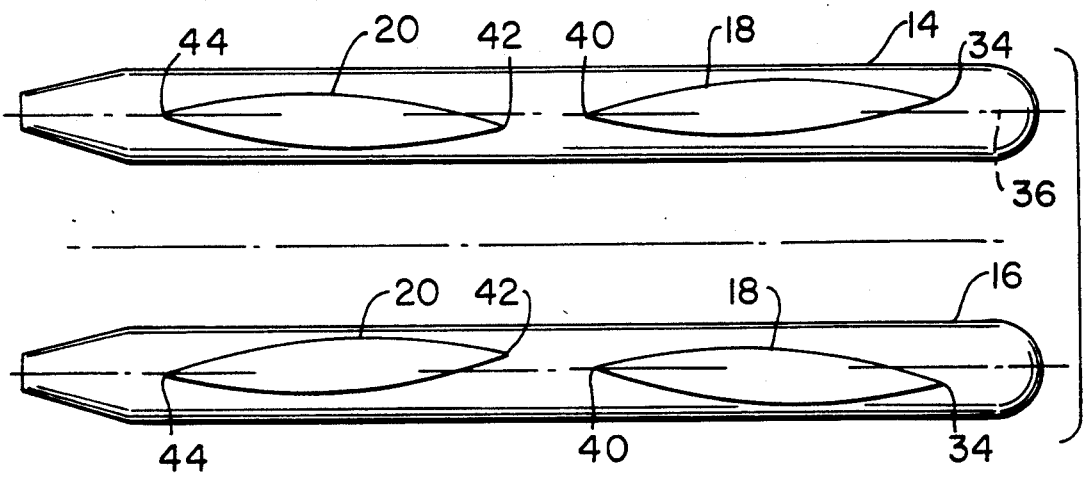
FIG. 10

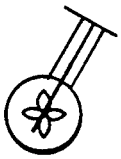
FIG. 12
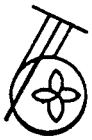
FIG. 12a
FIG. 11
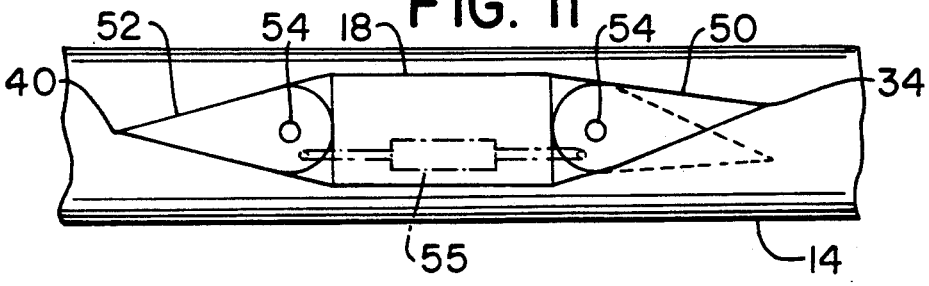
FIG. 13
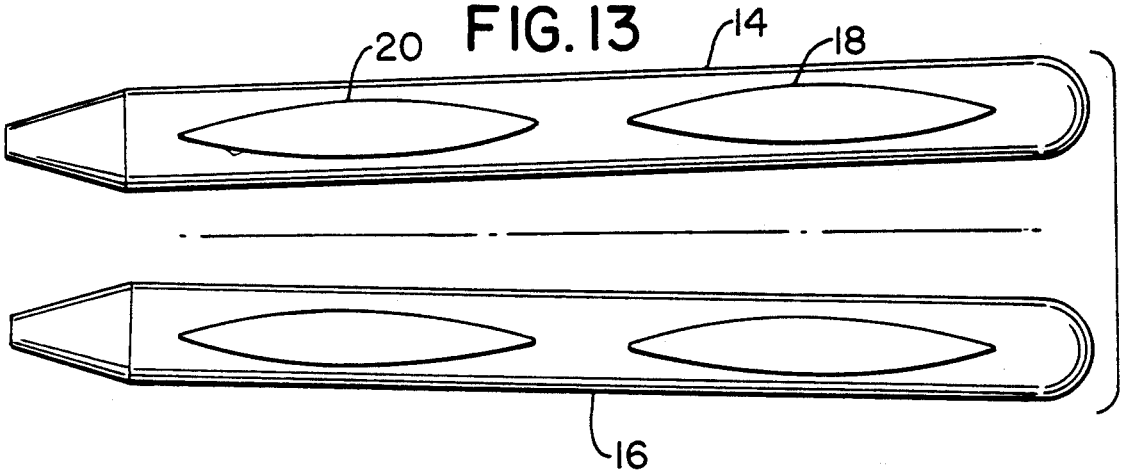
FIG. 14
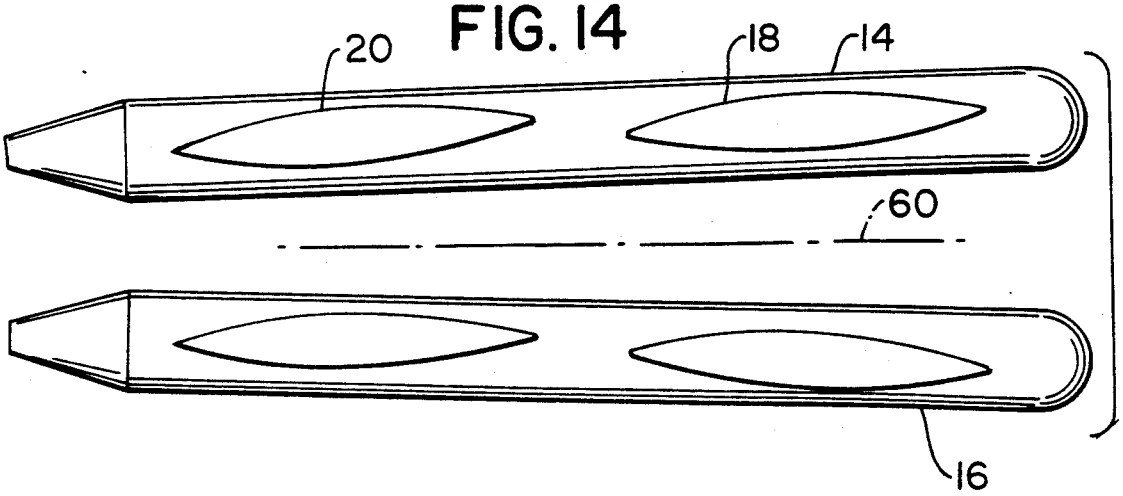

SMALL WATERPLANE TWIN HULL VESSEL

The present invention relates to small waterplane area twin hull vessels (also referred to as SWATH vessels) and more specifically to a SWATH vessel having an improved configuration of submerged hulls and struts.

BACKGROUND OF THE INVENTION

Small waterplane twin hull vessels generally consist of two submerged hulls, originally formed of uniform cross-section, connected to a work platform or upper hull by elongated struts which have a cross-section substantially smaller than the cross-section of the submerged hulls. It is for that reason that such vessels are characterized as "small waterplane twin hull" vessels.

Originally SWATH vessels utilized single struts between the two submerged hulls and the upper platform, as shown, for example, in U.S. Pat. No. 3.447,502, issued to Leopold and U.S. Pat. No. 4,552,083 issued to Schmidt. Some time ago, however, the Naval Ocean System Center at San Diego and Honolulu developed a new SWATH design characterized by having at least two struts associated with each submerged hull. These vessels were characterized by submerged twin hulls of uniform cross section with at least two narrow struts making the connection at the forward and aft ends of the submerged hulls and the upper platform. These struts typically extended vertically, as shown, for example, in U.S. Pat. Nos. 3,623,444 and 3,897,944, issued to Lang.

It has been found that SWATH vessels having multiple struts having better operational characteristics than conventional ships and can operate at much higher sea states.

Subsequent to these developments other improvements were made in SWATH vessels. For example, U.S. Pat. No. 4,174,671 to Seidl taught that the submerged hulls can have non-uniform cross-sections in order to obtain improved operational characteristics. U.S. Pat. No. 4,944,238 to Lang shows that the struts may have varying shapes along their length to improve handling characteristics in high seas. That patent, in FIG. 5, shows the concept of a negatively canted strut on a multi-strut vessel. Negative canting in this way produces a very wide vessel or a very narrow deck for the vessel.

In U.S. Pat. Nos. 4,557,211 and 4,798,153, Schmidt suggests canting single struts on a SWATH vessel outwardly or inclining the submerged hulls upwardly in order to counterbalance the tendency of SWATH vessels to run in a bow down condition. That kind of trim condition decreases the ship's stability and increases the possibility of propeller broaching and ventilating. Schmidt's designs were an attempt to correct such trim conditions and to avoid the necessity for additional power required in vessels such as shown in the abovementioned Lang patents that provide trim control surfaces which increase drag on the vessel.

SUMMARY OF THE INVENTION

SWATH vessels are characterized by good sea-keeping and low water resistance. Generally, SWATH vessels, as described above, can be divided into three structural components:

(1) the submerged lower hulls which provide the major portion of the buoyancy;

(2) the platform cross structure above the water which contains the control room of the vessel and the passenger accommodations and/or cargo holds; and (3) the water surface penetrating struts which connect the lower hulls and the upper platform cross structure.

The present invention deals specifically with modifications in the geometry of the water surface penetrating struts, the geometry of the lower hull and the geometry of selected appendages on the hull. The modification of the geometry of these elements, as described hereinafter, produces an optimum combination of configurations to achieve optimum operating characteristics for the vessel.

It has been thought in the past that the placement of submerged hulls parallel to the center line of the vessel is the optimum condition because that arrangement will meet least resistance of water. However, as described hereinafter, given the other forces involved on the SWATH vessel, particularly with multiple struts, it has been found that parallel hulls is not necessarily the optimum configuration. Applicant has also found that positive canting of the struts provides several additional advantages over both vertically position struts and negatively canted struts.

In conventional SWATH vessels the struts are vertical, as described above. In accordance with the present invention one of the geometry modifications provided is a strut arrangement wherein the multiple struts on each side of the vessel are not vertical but form a dihedral angle between the struts and the upper hull or support platform.

By definition when the intersection of the struts with the connecting cross structure or upper hull platform forms an angle larger than 90° the angle is referred to as a negative dihedral strut angle. Conversely, if the intersection angle is less than 90° the angle is referred to as a positive dihedral strut angle. The use of dihedral struts, also referred to herein as canted struts, improves the hydrodynamic and hydrostatic performance of the SWATH vessel. In particular, the dihedral strut angles, as described hereinafter, allow the struts to form lifting surfaces which produce a net vertical hydrodynamic lift on the vessel that is used to counteract the sinkage and trim moments which occur in SWATH vessels having vertical struts. In addition, multiple-canted struts increase viscous damping and increase the hydrodynamic added mass of the SWATH vessel. This results in reduced motions of SWATH vessels in a given seaway. Moreover, because the struts are at an angle to the waterplane area, the waterplane area of the strut is increased and this results in improved static stability of the vessel.

In order to produce a non-zero net lift on the struts, applicant has found that the cross-section of the struts are preferably non-symmetrical or that their leading edges have an angle of attack greater than zero with respect to the direction of travel of the vessel. Another method disclosed herein for achieving this result is to have the lower hulls and the connecting struts in a non-parallel position, i.e., either towed in or towed out. Yet another way of accomplishing this, either in conjunction with the toed in or toed out arrangement for the lower hulls, is to arrange the leading edges of the struts at an angle to the center line of the hulls and/or the vessel, or to provide a mechanical system for changing the position of the leading and trailing edges of the struts.

It has been found that because of the relatively complex configuration of SWATH vessels, particularly where multiple struts are used, second order flows of water passing over the submerged hulls and along the multiple struts create complex water flow interaction. One of these, as described in the above-mentioned Schmidt patents, involves the so-called Monk moment which causes SWATH vessels to tend to run "bow down." That required, in the past, counter ballast in the rear of the vessel or the use of transverse cannards, or the like, as suggested by the Lang patents.

Schmidt attempted to overcome the Monk moment by toeing the individual struts on his single strut vessels outwardly. However, toeing these struts outwardly too far creates too much drag on the vessel and reduces its operating efficiencies. Applicant has found that by toeing out the submerged hulls slightly with respect to the centerline of the vessel either alone or in conjunction with toed out struts, on a multiple strut vessel, will avoid the increase in drag experience by the Schmidt vessel and improve the operating characteristics of the vessel.

Various combinations of these angled relationships of the submerged hulls and the struts to the centerline of the vessel can be arranged as a function of the length of the ship or its width and weight, in order to achieve optimum operating conditions. By modifying the geometry of these structures, the wavemaking characteristics of the SWATH vessel can be reduced so that it will operate more efficiently and at higher speeds.

In addition, by canting the struts, Applicant has found that the struts can then be shaped as foil sections in order to provide lifting surfaces and further improve the lift created by the canted struts. And, by providing movable leading and trailing edges, better control of the lift provided by the struts is achieved.

In yet another embodiment of the invention the stability of the vessel can be further improved by varying the water plane area of the canted struts along their inclined axis. This arrangement will reduce the stiffness of motion characteristic of vessels with large stability and produces improved motion in the vessels when operating at low draft.

By modifying the various geometry characteristics of the vessel, as described in this application, a wide range of ships can be designed to accommodate a wide range of speeds while maintaining all of the advantages of a SWATH vessel in terms of stability and ability to handle high sea conditions.

The above described Seidl patent demonstrated that hydrodynamic shaping of major components in a SWATH vessel can improve operational conditions. The present invention demonstrates another generation of improvements which permit SWATH vessels to operate at higher speeds than conventional designs and will result in an improvement in operating characteristics. These design changes will also produce less motions than in conventional SWATH vessels.

Accordingly, it is an object of the present invention to produce an improved SWATH vessel.

Another object of the present invention is to provide an SWATH vessel in which the geometric characteristics of the vessel can be modified to attain improved operating conditions.

In accordance with an aspect of the present invention, a SWATH vessel is provided which includes a pair of submerged hulls and an upper hull platform. The submerged hulls and upper platform are connected by at least two struts associated with each submerged hull and are either toed in or toed out with respect to the centerline of the vessel. The struts are connected between the submerged hulls and the upper platform at either negative or positive dihedral angles. The struts themselves can be uniform or foil-shaped to provide improved lifting surfaces and their leading and trailing edges may be arranged at an angle to the centerline of their associated hulls, thereby to further improve operating conditions. Those leading and trailing edges may also be arranged to be movable, to allow the operator to adjust the operating characteristics of the vessel.

BRIEF DESCRIPTION OF THE DRAWINGS

The above, and other objects, features and advantages of the present invention will be apparent to those skilled in the art from the following detailed description of illustrative embodiments of the present invention when read in connection with the accompanying drawings, wherein:

FIG. 4 is a partial elevational view, similar to FIG. 3, showing one side of the SWATH vessel with a modified mounting for the negative dihedral struts;

FIG. 5 is a view, similar to FIG. 4, showing another mounting arrangement for the negative dihedral struts;

FIG. 5A is a partial view, similar to FIG. 5, but showing a positive dihedral strut angle;

FIG. 6 is a sectional view of the prior art arrangement for multi-strut SWATH vessels taken along line 6—6 of FIG. 2;

FIG. 10 is a sectional view, similar to FIG. 8, illustrating another non-symmetric arrangement of vertical struts in accordance with one embodiment of the present invention;

FIG. 11 is a sectional view, similar to FIG. 10, but of a single strut having adjustable leading and trailing edges;

FIGS. 12 and **12*a* are rear end views of the submerged hulls of FIGS. 4 and 5**, respectively, illustrating the relative position of the ship's rudder and propeller in these embodiments;

FIG. 13 is a plan view, similar to FIG. 6, showing a submerged hull arrangement wherein the hulls are toed out;

FIG. 14 is a view, similar to FIG. 13, showing a hull arrangement wherein canted struts are non-symmetrical with respect to the toed out hulls;

DESCRIPTION OF THE PREFERRED EMBODIMENTS

Figure 1:
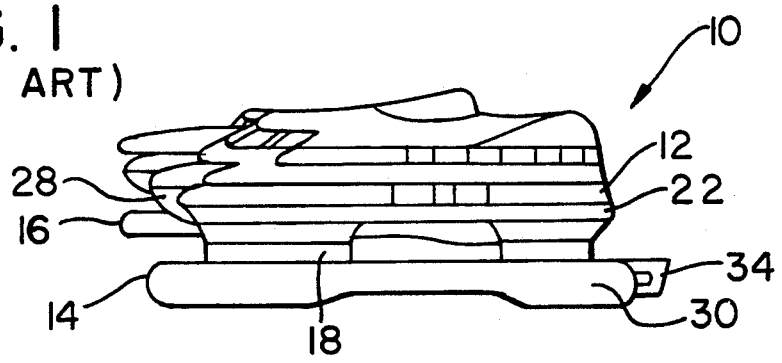
FIG. 1 (PRIOR ART)
FIG. 1 is a perspective view of a SWATH vessel of known construction.

Referring now to the drawings in detail, and initially to FIG. 1 thereof, a SWATH vessel 10 of known construction is illustrated which includes a main upper platform or hull 12, a pair of normally submerged hulls 14, 16, and a pair of struts 18, 20, located on each side of the hull and associated with the submerged hulls 14, 16. Upper hull 12 includes a pair of sponsons 22, located on either side of hull 12, to which the struts 18, 20 are connected. Sponsons 22 extend the length of the hull 12.

The prior art vessel 10 is generally constructed as illustrated and described in U.S. Pat. No. 4,174,671 and represents a currently operating vessel constructed according to that patent. The normally submerged hulls 14, 16 thereof have a varying cross-sectional diameter, as illustrated.

Figure 2:
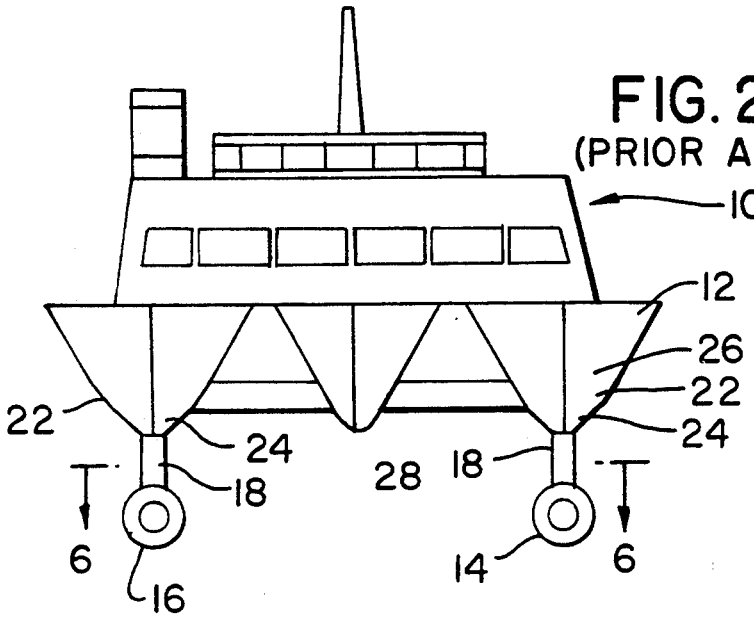
FIG. 2 (PRIOR ART)
FIG. 2 is a front elevational view of the vessel of FIG. 1 of illustrating the major components of the SWATH vessel.

As seen in FIG. 2 in the prior art SWATH vessel the generally submerged hulls 14, 16 extend parallel to the central axis of the vessel and parallel to each other. The struts 18 (only the forward struts are seen in FIG. 2) also extend parallel to each other. They also extend vertically, relative to the centerline of the lower hulls.

The upper portions 24 of struts 18, 20 are flared laterally outwardly to increase the effective buoyancy of the vessel when the ship encounters large waves. These flared portions of the struts are secured to the sponsons 22 which extend along the length of the ship on opposite sides thereof. The sponsons 22 are secured along the weld line 26, or the like, to the hull 12. Preferably, hull 12 includes a forward bow section 28, as illustrated in FIGS. 1 and 2, which is normally located above the design waterline of the vessel. Preferably, the design waterline is located along the height of the struts between the submerged hulls 14, 16 and the lower portions of the flared portions 24 of the struts.

The vessel 10 is driven by a propulsion system which preferably is located within the rear enlarged area 30 of one or both of the submerged hulls 14, 16. This propulsion system can be, for example, one or more diesel engines connected to a drive shaft for operating a propeller 32 located at the rear of each submerged hull. A steering rudder 34 or the like is mounted at the rear of the submerged hull in any convenient manner.

Figure 3:
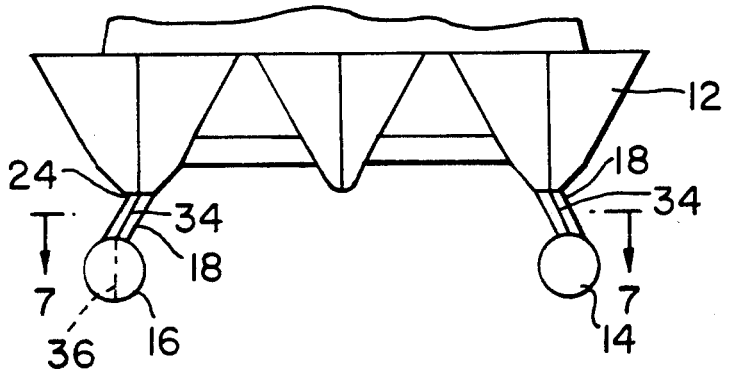
FIG. 3 is a partial front view, similar to FIG. 2, showing a negative dihedral strut arrangement for a SWATH vessel according to the present invention.

FIG. 3 of the drawing illustrates a first embodiment of the present invention designed to increase the lift of the vessel, particularly at the bow portion thereof in order to overcome the tendency, described above, for SWATH vessels to move forward in a bow-down position. As illustrated in FIG. 3, struts 18, 20 (struts 20 are not seen in the front view of FIG. 3) are positioned at an angle with respect to the hulls 14, 16. In this embodiment, the struts are inclined outwardly to define a negative dihedral angle with respect to the hull 12. Preferable, both the front and rear struts 18, 20 are canted in this manner. For ease of illustration the hulls 14, 16 in FIGS. 3–15 are shown as cylindrical tubes however, such hulls preferably are of more non-uniform cross section as taught in the Seidl patent described above.

In the illustrative embodiment of FIG. 3, the struts are secured to the submerged hulls 14, 16 such that a leading edge 34 of the struts align with the central vertical axis or plane 36 (shown in dotted lines in FIG. 3) of the submerged hulls. By positioning the struts in this manner, the struts generate additional vertical lift as the vessel moves forward in the water, thereby to apply a lifting pressure to the bow of the vessel during operation.

The precise position for connection of the lower end of the strut to the hulls 14, 16 can be varied, as shown, for example, in FIGS. 4 and 5. In the embodiment shown in FIG. 4, the strut 18 is secured to the right hand or upper inner quadrant of the hull 16, when viewed from the bow, so that an extension of the leading edge 34 of the strut will intersect the central axis 38 of the submerged hull.

In the embodiment illustrated in FIG. 5, the strut is secured at a position which is offset in the outboard direction from the vertical centerline of the submerged hull 16 so that it passes outboard of the centerline 38 of the hull. The lift characteristics of the SWATH vessel will be varied, depending upon which of these three positions (i.e. FIGS. 3, 4 or 5) of the hull is selected. Additionally, by selecting one or another of these three canted configurations, the geometry of the hull vessel with respect to the rudder and the propeller for the ship can be modified, thereby to further change the operating conditions of the vessel. For example, in the embodiment of FIG. 5, the rudder of the vessel can be mounted to be aligned with the trailing edge of the struts at an angle to the vertical axis 36 of the hull, and thereby be offset from the propeller, which is normally located along the centerline of the hull (See FIG. 12*a*). On the other hand, in the embodiment of FIG. 4 with the rudder aligned with the trailing edge of the struts, it will be directly behind and aligned with the axis of the propeller shaft (See FIG. 12).

In another embodiment of the invention illustrated schematically in FIG. 5A, (wherein only one of the hulls 16 of the vessel is illustrated) strut 18 is mounted in a positive dihedral angle so that the submerged hull 16 is located inwardly of the upper platform 12. This arrangement provides the same type of lift as the negative dihedral angle arrangements, but keeps the submerged hulls inboard where they are less likely to contact dock pilings, or the like, when the vessel is moored.

In the conventional SWATH vessel, as illustrated in FIG. 6, struts 18, 20 are normally located symmetrically along the centerline 36 of their associated submerged hulls. Typically, these struts are symmetrical in cross-section and, when in a vertical position, do not affect the lift forces imposed upon the vessel.

Applicant has found that by positioning canted struts in a non-symmetrical arrangement, as illustrated schematically in FIG. 10, with the leading edges 34 of the forward struts 18 further apart than their trailing edges 40, additional lift forces can be generated to overcome the normal tendency of the SWATH vessel to move forward in a bow down position. The aft struts 20 may be positioned either symmetrically with respect to the hulls 14, 16, as in the prior art arrangement shown in FIG. 6, or they may be non-symmetrical with their leading edges 42 closer together than their trailing edges 44, as illustrated in FIG. 10. This also will produce additional lift forces that will affect the operational characteristics of the vessel.

Although in the illustrative embodiment of FIG. 10 the trailing edges 44 of struts 20 are located on the centerline of the hulls, further adjustments in the operational characteristics of the vessel can be achieved by locating those trailing edges off center from the centerline 36 of the hulls, i.e. outboard thereof. The non-symmetrical arrangement of FIG. 10 can be used with canted struts defining either negative or positive dihedral angles, as illustrated in FIGS. 3–5A.

Figure 7:
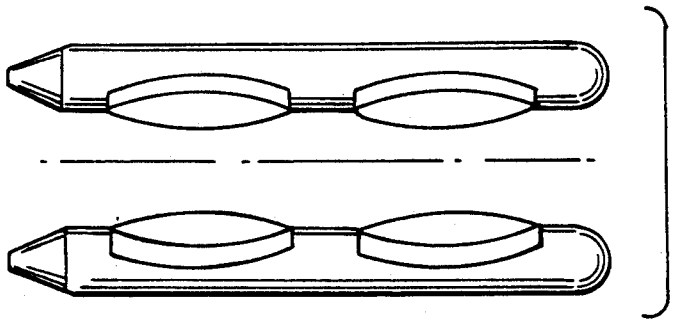
FIG. 7 is a sectional view taken along line 7—7 of FIG. 3.

FIG. 7 of the drawing illustrates an embodiment of the invention wherein the struts are symmetrical in cross section and located at a negative dihedral angle.

Figure 8:
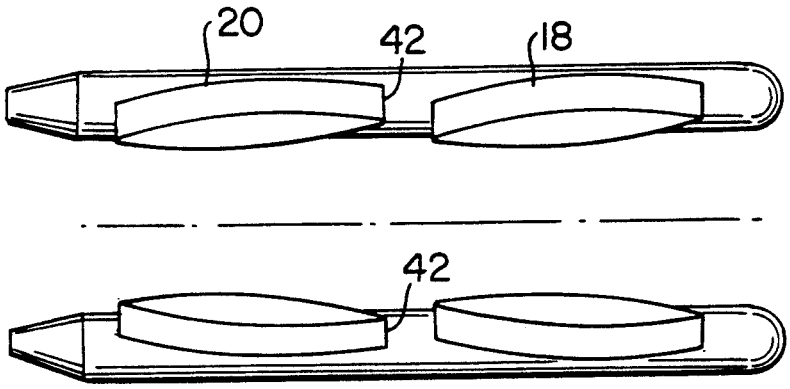
FIG. 8 is a sectional view, similar to FIG. 7, illustrating the non-symmetric arrangement of the struts according to one embodiment of the present invention.

In yet another embodiment of the present invention, illustrated in FIG. 8 of the drawing, canted struts 18, 20 which are symmetrical in cross-section are shown in a negative dihedral position but with the struts arranged in a non-symmetrical configuration with respect to the central axis or plane of the submerged hulls as described above with respect to FIG. 10. In this embodiment of the invention, however, a further modification is illustrated wherein the forward edges 42 of the aft struts 20 are also positioned outboard of the centerline of the vessel.

Applicant has found that the offset of the struts 18, 20 necessary to obtain additional lift forces need not be great. For example, Applicant has found that a "toe out" of the forward struts of 2° relative to the centerline of the vessel and/or a "toe in" of the aft struts of 2° will produce satisfactory improved results.

Figure 9:
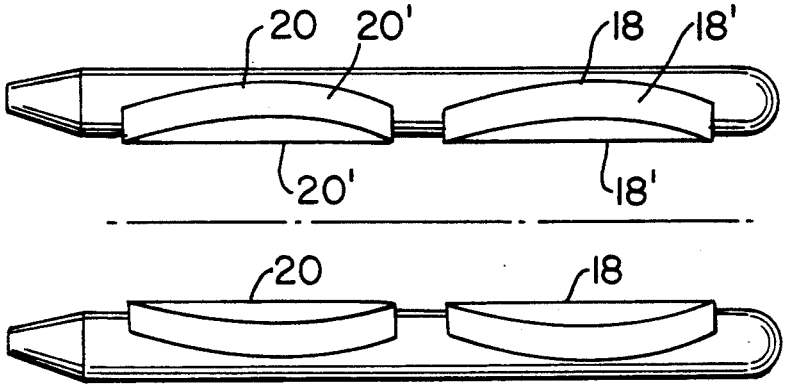
FIG. 9 is a sectional view, similar to FIG. 7, showing the use of foil-shaped struts.

FIG. 9 of the drawings illustrates yet another embodiment of the invention which will produce increased lift on the vessel to overcome the vessel's tendency to move forward in a bow down position. In this embodiment canted struts 18, 20 are positioned in a negative dihedral angle (although they could be positioned in a positive dihedral angle) with the struts having a non-symmetrical cross-section. In this embodiment, the outboard surface 18', 20' of the struts are cambered or curved at a smaller radius of curvature than the inboard surfaces 18'', 20''. By cambering the struts in this manner, additional lift forces are provided in a manner similar to that of an aircraft wing. In this embodiment the struts are illustrated with their leading and trailing edges aligned with the central axis or plane of hulls 14, 16. However, additional lift can be achieved by arranging these struts non-symmetrically as described above with respect to the embodiment of FIG. 10.

In the previously illustrated embodiments, the struts are defined as fixed structures. However, to further enable the operator of the vessel to control its operating characteristics, it is contemplated that either or both of the leading and trailing edges of the struts can be provided with movable surfaces. Thus, as illustrated in FIG. 11, struts 18 (as well as the struts 20) can have a forward section 50 and a rear section 52 which are pivotally secured to the strut along a pivot pin 54 or the like so that the leading or trailing edge can be moved relative to the centerline of the hull. Movement of this structure can be achieved in any desired manner as, for example, by hydraulic rams 55 located within the strut and pivotally connected to the movable sections 50. By operation of the rams 55, the position of the leading and trailing edges can be varied during operation of the vessel to modify its operational characteristics Yet another embodiment of the invention is illustrated in FIG. 13. In this embodiment, hulls 14, 16 are secured by the struts to the upper platform structure at an angle to each other, i.e., to form an acute angle between them when viewed in plan. In the embodiment of FIG. 13 the hulls are toed out at the bow with respect to each other and the struts 18, 20 are positioned symmetrically along the centerline of the hulls. In this embodiment, the struts can be either vertical or canted in a positive or negative dihedral angle. By toeing the hulls out in this manner lifting forces are produced as the struts pass through the water which tend to raise the bow of the vessel. Further lift can be produced on the vessel, if desired, by constructing the vessel with the struts 18, 20 in non-symmetrical positions with respect to the toed out hulls, as illustrated in FIG. 14. In this configuration struts 18, 20 are secured to hulls 14, 16 in the manner described above with respect to FIG. 10, but the hulls are toed out as well. Applicant has found that toeing the hulls out with respect to each other by a small angle of 1° to 2° with respect to the centerline 60 of the vessel, will produce additional lifting forces that will improve the operational characteristics of the vessel. On extremely long vessels an angle of less than 10 (i.e. ¼° or ½°) will provide sufficient lift. In some vessels an angle as great as 5° can be used.

Figure 15:
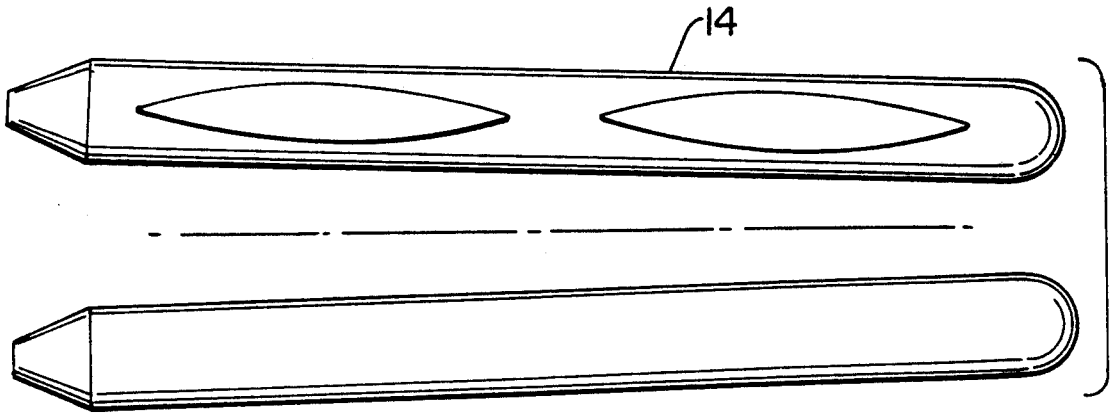
FIG. 15 is a sectional view, similar to FIG. 6, showing a toed in hull arrangement.

In yet another embodiment of the invention illustrated in FIG. 15, hulls 14, 16 are toed in with respect to each other. In this embodiment the hulls define an acute angle between them whose apex is forward of the vessel. Here, again, the positioning of the struts at an angle to the forward direction of movement of the vessel will produce lift forces on the vessel. Also, the struts can be vertical, as illustrated in FIG. 15, or they can be canted at a negative or positive dihedral angle.

Figure 16:
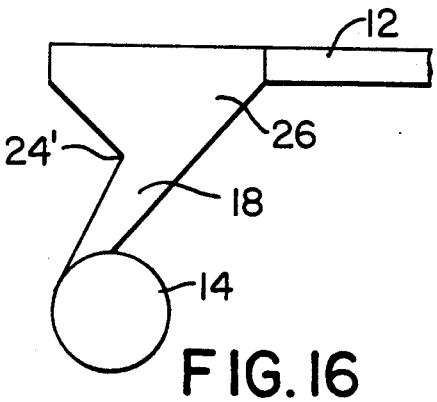
FIG. 16 is a view similar to FIG. 4 showing a negative diehedral strut having a varying waterplane area along its inclined axis.
Figure 17:
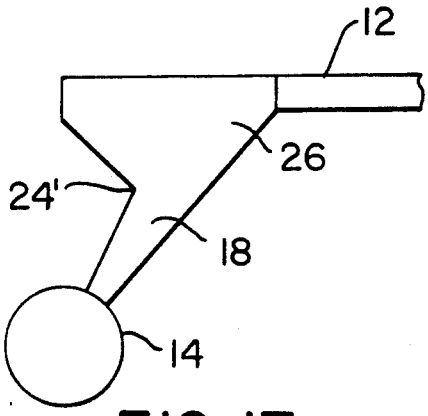
FIG. 17 is a view similar to FIG. 16 of another embodiment of the invention.

In the previously described embodiments the struts have a uniform cross-sectional area along their longitudinal axis from the base 24' of the flared portion of the strut to its juncture with the submerged hull. As a result the vessel has a constant water plane area regardless of the operating draft of the vessel (which of course varies as a function of ballast and load). With such a construction, particularly with negatively canted struts, the SWATH vessel will have its minimum stability when the operating water line is at the top of the strut at the juncture 24' (maximum draft) and stability will increase with decreasing draft. This can produce excess stability at lower drafts and that is undesirable since it increases the "stiffness" of motion of the vessel. This problem can be overcome by varying the waterplane area of the canted struts along their inclined axis. In the embodiment of FIG. 16 the thickness or cross sectional area of the strut increases upwardly from hull 14 to point 24'. As seen therein the strut 18 joins the hull 14 in the upper outboard quadrant. Alternatively, as seen in FIG. 17, the strut can join the hull in its upper inboard quadrant. In the FIG. 16 embodiment the distance of the lower hulls to centerline of the vessel is less than with the embodiment of FIG. 17 and permits the construction of vessels with smaller overall width.

Figure 19:
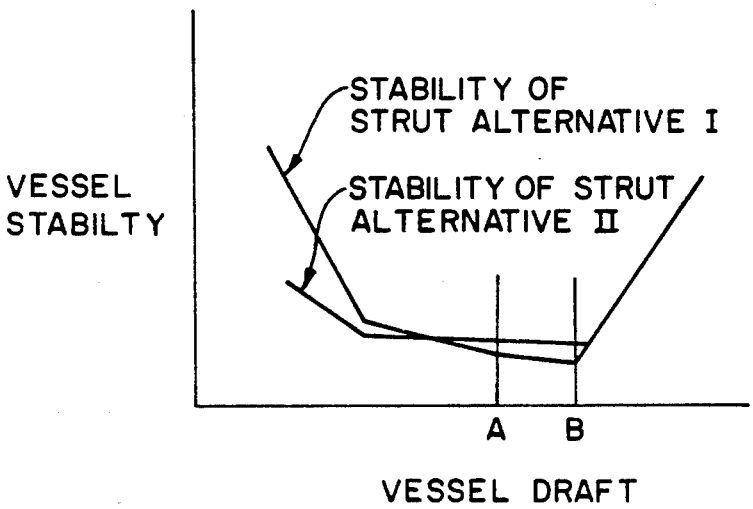
FIG. 19 is a chart showing the effect on stability of a varying water plane area strut as compared to uniform water plane area struts.

FIG. 19 depicts a chart showing the relative stability of a vessel constructed according to FIG. 16 as compared to a vessel as shown in FIG. 5. In the chart vessel stability is defined as the transverse metacentric height (GMt). As seen therein for a vessel having uniform cross-section struts (as in FIG. 5) the stability of the SWATH vessel will assume a minimum value at the draft level 24' i.e. at the juncture of the straight section of the strut with the flared section At that draft the constant water plane area of the canted strut is a the minimum distance from the ship's centerline. Thus the stability is at a minimum. This draft condition is typically close to the design water line (DWL) of the vessel. Thus, as seen in FIG. 19 at ship drafts lower than 24' the stability of the vessel will increase since the water plane area of the struts are at a larger distance to the ship's centerline. This produces excess stability at lower drafts and that produces undesirable stiffness in vessel motion at low drafts.

When the struts have a varying thickness, as shown in FIG. 16, the stability of the vessel at draft 24' as well as at DWL will be greater since the waterplane area at these points is greater than the waterplane area of an untapered strut. However, at lower drafts the stability of the vessel of FIG. 15 is less than that of FIG. 5 even with the same distance between the struts and the centerline of the vessel. This produces less stiffness in vessel motion at low drafts.

Figure 18:
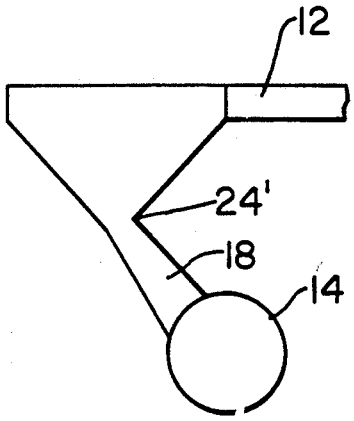
FIG. 18 is a view similar to FIG. 17 of another embodiment of the invention showing a positive dihedral strut having a varying waterplane area.

A similar effect can be achieved with positive dihedral canted struts by having the struts thicker at their juncture with the submerged hulls than at their juncture with the flared section of the struts. This is illustrated in FIG. 18.

Applicant has found that by combining these various modifications in a vessel, optimal design and operational characteristics for the vessel can be achieved depending upon the design parameters of the ship, i.e., weight, length and draft. Also, the design speed of the vessel will affect the lifting forces on the vessel at design speed and the various structural modifications described above can be selected and adjusted with respect to the design speed to achieve optimum operational characteristics for the intended vessel.

Another design feature of certain embodiments of the present invention is that in order to reduce resistance of the movement of the vessel through the water, particularly at the design waterline where bow waves and cross waves are produced, the cross sectional area of the struts at the design waterline should have the smallest cross-sectional area of any portion of the vessel below that design waterline.

The various modifications and variations of the geometry for a SWATH vessel as described above permit the construction of more stable SWATH vessels capable of operating at a wider range of speeds than previously proposed SWATH vessels.

Although illustrative embodiments of the present invention have been described herein with reference to the accompanying drawings, it is to be understood that various changes and modifications may be effected therein by those skilled in the art without departing from the scope or spirit of this invention.

What is claimed is:

1. A marine SWATH vessel comprising a pair of hulls for providing buoyancy support for the vessel and adapted to be submerged below the water surface when the vessel is in operation; an upper hull platform adapted to be located above the design waterline of the vessel when the vessel is in operation; and at least two longitudinally spaced struts connected between each of said submerged hulls and said upper hull platform, said submerged hulls being arranged to define an acute angle between them whose vertex is rearward of the submerged hulls and located along the centerline of the vessel whereby said submerged hulls are toed out with respect to each other and effect the lift forces applied to the vessel; and wherein the angle defined between the centerline of the vessel and the centerline of the submerged hulls is greater than 0° and less than 5°.

2. A marine vessel as defined in claim 1 wherein said struts are connected to the hull platform at a predetermined dihedral angle.

3. A marine vessel as defined in claim 2 wherein said dihedral angle is positive.

4. A marine vessel as defined in claim 2 wherein said dihedral angle is negative.

5. A marine vessel as defined in claim 2 wherein said struts each have leading and trailing edges located along the centerline of the submerged hulls.

6. A marine vessel as defined in claim 2 wherein the struts associated with each submerged hull include a forward strut and said forward struts have leading and trailing edges, with the leading edges of said forward struts being outboard of the centerline of their associated submerged hull.

7. A marine vessel as defined in claim 1 wherein said struts have a varying cross-sectional area between said submerged hulls and said upper hull platform.

8. A marine vessel comprising a pair of hulls for providing buoyancy support for the vessel and adapted to be submerged below the water surface when the vessel is in operation; an upper hull platform adapted to be located above the design water line of the vessel when the vessel is in operation; and at least one pair of struts associated with each of said submerged hulls and connecting their associated submerged hulls to said upper hull platform, said struts being connected to the hull platform at a predetermined dihedral angle and each pair of struts including a forward strut; said forward struts having leading and trailing edges, with the leading edges of said forward struts being outboard of the center line of their associated submerged hulls; said submerged hulls being arranged to define an acute angle between them which is greater than zero (0°) degrees and less than five (5°) degrees and whose vertex is rearward of the submerged hulls and located along the center line of the vessel whereby said submerged hulls are toes out with respect to each other; said struts associated with each submerged hull including aft struts and said aft struts having leading and trailing edges with the leading edges of said aft struts being inboard of the centerline of their associated submerged hulls.

9. A marine SWATH vessel comprising a pair of hulls for providing buoyancy support for the vessel and adapted to be submerged below the water surface when the vessel is in operation; an upper hull platform adapted to be located above the design waterline of the vessel when the vessel is in operation; and at least two longitudinally spaced struts connected between each of said submerged hulls and said upper hull platform, said submerged hulls being arranged to define an acute angle between them whose vertex is rearward of the submerged hulls and located along the centerline of the vessel whereby said submerged hulls are toed out with respect to each other and effect the lift forces applied to the vessel; and wherein said struts include leading and trailing edges and means for varying the position of said leading and trailing strut edges relative to the centerline of the submerged hulls.

10. A marine vessel as defined in claim 9 wherein said struts have a varying cross-sectional area between said submerged hulls toward said upper hull platform.

11. A marine vessel comprising a pair of hulls for providing buoyancy support for the vessel and adapted to be below the water surface when the vessel is in operation; an upper hull platform located above the design water line of the vessel when the vessel is in operation; and at least one pair of struts associated with each of said submerged hulls and connecting their associated submerged hulls to said upper hull platform, said hulls each having a longitudinally extending vertical centerline plane and inner and outer quadrant sections, said struts being connected to said hull platform at a predetermined negative dihedral angle and to said submerged hulls at the outer upper quadrants of the submerged hulls asymmetrically to the centerline thereof; and a rudder respectively associated with the trailing ends of each of said submerged hulls, axially aligned with said struts and located outboard of the centerlines of the submerged hulls.

12. A marine SWATH vessel comprising a pair of hulls for providing buoyancy support for the vessel and being submerged below the water surface when the vessel is in operation; an upper hull platform adapted to be located above the design waterline of the vessel when the vessel is in operation; and at least one pair of struts associated with each of said submerged hulls and connecting their associated submerged hulls to said upper hull platform, said struts being connected to said hull platform at a predetermined dihedral angle; said struts having leading and trailing edges and said at least one pair of struts associated with each of said submerged hulls including a forward strut and an aft strut, with the leading edges of said forward struts being located outboard of the centerline of their associated submerged hulls and the leading edges of the aft struts being located inboard of the centerline of their associated submerged hulls; wherein said struts include means for varying the position of said leading edges thereof relative to the centerline of the submerged hulls.

13. A marine vessel as defined in claim 12 wherein the trailing edges of said struts are located along the centerline of said submerged hulls.

14. A marine vessel as defined in claim 12 wherein said struts have a varying cross-sectional area between said submerged hulls toward said upper hull platform.

15. A marine SWATH vessel comprising a pair of hulls for providing buoyancy support for the vessel and being submerged below the water surface when the vessel is in operation; an upper hull platform adapted to be located above the design waterline of the vessel when the vessel is in operation; and at least one pair of struts associated with each of said submerged hulls and connecting their associated submerged hulls to said upper hull platform, said struts being connected to said hull platform at a predetermined dihedral angle; said struts having leading and trailing edges and said at least one pair of struts associated with each of said submerged hulls including a forward strut and an aft strut, with the leading edges of said forward struts being located outboard of the centerline of their associated submerged hulls and the leading edges of the aft struts being located inboard of the centerline of their associated submerged hulls; wherein said struts include means for varying the positions of said trailing edges thereof relative to the centerline of the submerged hulls.

16. A marine SWATH vessel comprising a pair of hulls for providing buoyancy for the vessel and being submerged below the water surface when the vessel is in operation; an upper hull platform adapted to be located above the design waterline of the vessel when the vessel is in operation; and at least one pair of struts associated with each of said submerged hulls and connecting their associated submerged hulls to said upper hull platform, said submerged hulls being arranged to define an acute angle between them when viewed in plan and wherein the waterplane area of the struts at the design water line is smaller in area than the largest waterplane area of any structure below the design waterline; wherein the angles defined between the centerline of the vessel and the centerline of the submerged hulls is greater than 0° and less than 5°.

17. A marine vessel as defined in claim 16 wherein said struts have a varying cross-sectional area between said submerged hulls toward said upper hull platform.

18. A marine vessel as defined in claim 16 wherein the submerged hulls define an angle between them whose vertex is rearward of the submerged hulls and located along the centerline of the vessel whereby said submerged hulls are toed out with respect to each other.

19. A marine vessel as defined in claim 16 wherein the submerged hulls define an angle between them whose vertex is forward of the submerged hulls and located along the centerline of the vessel whereby said submerged hulls are toed in with respect to each other.

20. A marine vessel as defined in claim 16 wherein said struts are connected to the hull platform at a predetermined dihedral angle.

21. A marine vessel as defined in claim 20 wherein said dihedral angle is positive.

22. A marine vessel as defined in claim 20 wherein said dihedral angle is negative.

23. A marine vessel as defined in claim 16 wherein the struts include a forward pair of struts having leading and trailing edges, with the leading edges of the struts being spaced further apart from each other than the trailing edge.

24. A marine vessel as defined in claim 16 wherein the struts include a forward pair of struts having leading and trailing edges, with the trailing edges of the struts being spaced further apart from each other than the leading edges.

25. A marine vessel as defined in claim 16 wherein said struts are asymmetrical in cross-section.

26. A marine vessel as defined in claim 25 wherein said struts have opposed inboard and outboard cambered surfaces wherein the inboard cambered surface has less camber than the outboard surface.

27. A marine SWATH vessel comprising a pair of hulls for providing buoyancy for the vessel and being submerged below the water surface when the vessel is in operation; an upper hull platform adapted to be located above the design waterline of the vessel when the vessel is in operation; and at least one pair of struts associated with each of said submerged hulls and connecting their associated submerged hulls to said upper hull platform, said submerged hulls being arranged to define an acute angle between them when viewed in plan and wherein the waterplane area of the struts at the design waterline is smaller in area than the largest waterplane area of any structure below the design waterline; wherein said struts have leading and trailing edges and include means for varying the position of said leading edges relative to their associated submerged hull.

28. A marine SWATH vessel comprising a pair of hulls for providing buoyancy for the vessel and being submerged below the water surface when the vessel is in operation; an upper hull platform adapted to be located above the design waterline of the vessel when the vessel is in operation; and at least one pair of struts associated with each of said submerged hulls and connecting their associated submerged hulls to said upper hull platform, said submerged hulls being arranged to define an acute angle between them when viewed in plan and wherein the waterplane area of the struts at the design waterline is smaller in area than the largest waterplane area of any structure below the design waterline; wherein said struts having leading and trailing edges and include means for varying the position of said trailing edges relative to their associated submerged hull.

29. A marine SWATH vessel comprising a pair of hulls for providing buoyancy support for the vessel and being submerged below the water surface when the vessel is in operation; an upper hull platform adapted to be located above the design waterline of the vessel when the vessel is in operation; and at least one pair of struts associated with each of said submerged hulls and connecting their associated submerged hulls to said upper hull platform; said struts being arranged to define a dihedral angle with said upper hull platform and wherein the waterplane area of the struts at the design waterline is smaller in area than the largest waterplane area of any structure below the design waterline; said struts including a forward pair of struts having leading and trailing edges, with the leading edges of the struts being spaced further apart from each other than the trailing edges; said submerged hulls extending generally longitudinally on opposite sides of the centerline of the vessel; and said struts having leading and trailing edges and include means for varying the position of said leading edges relative to their associated submerged hull.

30. A marine vessel as defined in claim 29 wherein said struts have a varying cross-sectional area between said submerged hulls toward said upper hull platform.

31. A marine SWATH vessel comprising a pair of hulls for providing buoyancy support for the vessel and being submerged below the water surface when the vessel is in operation; an upper hull platform adapted to be located above the design waterline of the vessel when the vessel is in operation; and at least one pair of struts associated with each of said submerged hulls and connecting their associated submerged hulls to said upper hull platform; said struts being arranged to define a dihedral angle with said upper hull platform and wherein the waterplane area of the struts at the design waterline is smaller in area than the largest waterplane area of any structure below the design waterline; said struts including a forward pair of struts having leading and trailing edges, with the leading edges of the struts being spaced further apart from each other than the trailing edges; said submerged hulls extending generally longitudinally on opposite sides of the centerline of the vessel; and said struts having leading and trailing edges and include means for varying the position of said trailing edges relative to their associated submerged hull.

32. A marine SWATH vessel comprising a pair of hulls for providing buoyancy support for the vessel and being submerged below the water surface when the vessel is in operation; an upper hull platform adapted to be located above the design waterline of the vessel when the vessel is in operation; and at least one pair of struts associated with each of said submerged hulls and connecting their associated submerged hulls to said upper hull platform, said struts including leading and trailing edges and being connected to said submerged hulls with the leading edges of the struts on opposite sides of the vessel being spaced apart at a different dimension from said trailing edges at least between the design waterline and their associated submerged hulls; said submerged hulls extending generally longitudinally on opposite sides of the centerline of the vessel; and said struts having leading and trailing edges and include means for varying the position of said leading edges relative to their associated submerged hull.

33. A marine vessel as defined in claim 32 wherein said struts have a varying cross-sectional area between said submerged hulls and said upper hull platform.

34. A marine vessel as defined in claim 32 wherein the struts associated with each submerged hull include a forward strut and said forward struts have leading and trailing edges with the leading edges of said forward struts being outboard of the centerline of their associated submerged hull.

35. A marine vessel as defined in claim 32 wherein said struts have opposed inboard and outboard cambered surfaces wherein the inboard cambered surface has less camber than the outboard surface.

36. A marine vessel as defined in claim 32 wherein said struts have symmetrical inboard and outboard surfaces and leading and trailing edges with the distances between leading edges on adjacent struts being greater than the distance between the trailing edges thereof.

37. A marine vessel as defined in claim 32 wherein said struts are asymmetrical in cross-section.

38. A marine vessel as defined in claim 32 whereas said struts have leading and trailing edges and include means for varying the position of said leading edges relative to their associated submerged hull.

39. A marine SWATH vessel comprising a pair of hulls for providing buoyancy support for the vessel being submerged below the water surface when the vessel is in operation; said submerged hulls extending generally longitudinally on opposite sides of the center line of the vessel; an upper hull platform adapted to be located above the design waterline of the vessel when the vessel is in operation; and at least one pair of struts associated with each of said submerged hulls and connecting their associated submerged hulls to said upper hull platform, said struts including leading and trailing edges and being connected to said submerged hulls with the leading edges of the struts on opposite sides of the vessel being spaced apart at a different dimension from said trailing edges at least between the design water line and their associated submerged hulls; said pairs of struts each including a forward strut, and the leading edges of said forward struts being outboard of the centerline of their associated submerged hulls; said pairs of struts associated with each submerged hull including aft struts and the leading edges of said aft struts being inboard of the centerline of their associated submerged hulls.

40. A marine vessel comprising a pair of hulls for providing buoyancy support for the vessel and being submerged below the water surface when the vessel is in operation; an upper hull platform adapted to be located above the design waterline of the vessel when the vessel is in operation; and at least one pair of struts associated with each of said submerged hulls and connecting their associated submerged hulls to said upper hull platform, said struts including leading and trailing edges and being connected to said submerged hulls with the leading edges of the struts on opposite sides of the vessel being spaced apart at a different dimension from said trailing edges at least between the design waterline and their associated submerged hulls; said submerged hulls extending generally longitudinally on opposite sides of the centerline of the vessel; and said struts having leading and trailing edges and include means for varying the position of said trailing edges relative to their associated submerged hull.

41. A marine vessel as defined in claim 19 wherein said dihedral angle is positive.

42. A marine vessel as defined in claim 41 wherein said dihedral angle is negative.

* * * * *